US006889031B2

(12) United States Patent
Tsuchida

(10) Patent No.: US 6,889,031 B2
(45) Date of Patent: May 3, 2005

(54) IMAGE FORMING APPARATUS

(75) Inventor: Takeshi Tsuchida, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/788,451

(22) Filed: Mar. 1, 2004

(65) Prior Publication Data

US 2004/0175215 A1 Sep. 9, 2004

(30) Foreign Application Priority Data

Mar. 7, 2003 (JP) ..... 2003-061694

(51) Int. Cl.[7] ..... G03G 15/00; B41J 13/10; B65H 7/02

(52) U.S. Cl. ..... 399/401; 399/395; 400/642; 400/579; 400/632; 271/227; 271/242

(58) Field of Search ..... 399/401, 395; 400/642, 579; 271/227, 242

(56) References Cited

U.S. PATENT DOCUMENTS 5,757,407 A * 5/1998 Rezanka ..... 347/102
5,904,350 A * 5/1999 Creighton et al. ..... 271/227
6,585,439 B2 * 7/2003 Johnson et al. ..... 400/642
6,805,347 B2 * 10/2004 Kuramoto ..... 271/242
2004/0174552 A1 * 9/2004 Miyake et al. ..... 358/1.12

FOREIGN PATENT DOCUMENTS

JP 2001305914 * 11/2001

* cited by examiner

*Primary Examiner*—Andrew H. Hirshfeld
*Assistant Examiner*—Marvin Crenshaw
(74) *Attorney, Agent, or Firm*—Fitzpatrick, Cella, Harper & Scinto

(57) ABSTRACT

An image forming apparatus in that a sheet having an image formed on a first side thereof by an image forming portion is again transported to the image forming portion so that an image may be formed on an opposite or second side of the sheet, the image forming apparatus including a sheet feeding portion, a re-transport path, a pair of registration rollers provided upstream of the image forming portion, and a loop forming space provided upstream of the pair of registration rollers so as to form the loop, wherein an entrance to the loop forming space for the sheet having passed along the re-transport path is formed downstream of an entrance to the loop forming space for the sheet fed from the sheet feeding portion.

8 Claims, 17 Drawing Sheets

IMAGE FORMING APPARATUS

BACKGROUND OF THE INVENTION

1. Field of the Invention

The invention relates to an image forming apparatus, and particularly to an image forming apparatus designed such that a sheet having an image formed on a first side thereof by an image forming portion is again transported to the image forming portion so that an image may be formed on an opposite or second side of the sheet.

2. Related Background Art

Some of image forming apparatus such as copying machines, printers and facsimile apparatuses have heretofore been designed such that for example, a sheet having an image formed on a first side thereof by an image forming portion is again transported to the image forming portion so that an image may be formed on a second side of the sheet.

FIG. 16 of the accompanying drawings schematically shows the construction of a copying machine which is an example of such conventional image forming apparatuses, and in FIG. 16, the reference numeral 100 designates a copying machine, and the reference character 100A denotes a copying machine main body (hereinafter referred to as the apparatus main body), and a scanner portion 30 which is an image reading portion is disposed in the upper portion of the apparatus main body 100A, and an image forming portion 51 for forming an image on a sheet P is disposed in the central portion of the apparatus main body, and further, a cassette feeding portion 16 and a multi-feeding portion 40 which are a sheet feeding portion for feeding the sheet P to the image forming portion 51 are disposed in the lower portion of the apparatus main body.

Further, on a side portion of the apparatus main body 100A, there is provided a duplex transport portion 60 for again feeding the sheet P to the image forming portion 51 to form an image on the back side (second side) of the sheet P after an image has been formed on one side (first side) of the sheet P so that images can be formed on the two sides of the sheet P.

The image forming portion 51 has an electrophotographic photosensitive drum (hereinafter referred to as the photosensitive drum) 52, a developing device 53, etc. Design is made such that when a laser beam corresponding to image information emitted from a laser scanner 54 is scanned on the surface of the photosensitive drum 52, a latent image is formed on the surface of the photosensitive drum, and this latent image is developed by the developing device 53, whereby a toner image is formed on the surface of the photosensitive drum.

Design is also made such that when thereafter, the sheet is transported to a transferring portion constituted by the photosensitive drum 52 and a transfer charging device 55 as will be described later, the toner image formed on the photosensitive drum 52 is transferred to the sheet.

On the other hand, the cassette feeding portion 16 is for feeding the sheet to the transferring portion, and is provided with a sheet cassette 17 loaded on the bottom of the apparatus main body 100A, and a feeding roller 18 for feeding the sheets P contained in the sheet cassette 17. Design is made such that during image forming, the feeding roller 18 and a pair of retard rollers 19 are rotated in conformity with an image forming operation so as to separate and feed the sheets P one by one from the sheet cassette 17.

The multi-feeding portion 40 is also for feeding the sheet P, and is provided with a tray 41 openably and closably provided in the apparatus main body 100A, and a feeding roller 42 for feeding the sheets P stacked on the tray 41. Design is made such that during image forming, the feeding roller 42 is rotated in conformity with the image forming operation so as to feed the sheets P one by one from the tray 41.

On the other hand, the scanner portion 30 is for reading the image of an original placed on an original glass stand 301, and is designed to convert image information into an electrical image signal after it has read the image of the original, and input the image information converted into this electrical image signal to the laser scanner 54 of the already described image forming portion 51.

Description will now be made of the image forming operation of the copying machine 100 constructed as described above.

First, when the image information of the original is red by the scanner portion 30, this image information is image-processed, whereafter it is converted into an electrical signal and transmitted to the laser scanner 54 of the image forming portion 51. In some cases, the image information is inputted from an external device such as a personal computer (not shown) to the image forming portion 51.

In the image forming portion 51, the surface of the photosensitive drum 52 is scanned by a laser beam corresponding to the image information emitted from the laser scanner 54 to thereby form a latent image on the photosensitive drum, whereafter this latent image is developed by the developing device 53, whereby a toner image is formed on the surface of the photosensitive drum 52.

On the other hand, when in parallel to this operation, the sheets P are to be fed from the multi-feeding portion 40 to the image forming portion 51, the sheets P are fed one by one from the tray by the feeding roller 42. Also, when the sheets P are to be fed from the cassette feeding portion 16, the sheets P contained in the sheet 17 cassette are separated and fed one by one by the feeding roller 18 and the pair of retard rollers 19.

The sheet P thus fed from the multi-feeding portion 40 or the cassette feeding portion 16 is transported to a pair of registration rollers 1. At this time, the pair of registration rollers 1 which are registration means are at a halt, whereby the sheet P has its skew feed corrected, and is once stopped at this position and stands by. Thereafter, the pair of registration rollers 1 are rotated and the sheet P which has stood by is fed to the transferring portion constituted by the photosensitive drum 52 and the transfer charging device 55 in timed relationship therewith, and the toner image on the photosensitive drum is transferred to the sheet P when the sheet P passes through the nip part of the transferring portion.

The sheet P to which the toner image has been transferred in this manner is transported to a fixing apparatus 56, and is heated and pressurized when it passes through the fixing apparatus 56, whereby the toner image is fixed on the surface of the sheet. The sheet P on which the toner image has been thus fixed is thereafter delivered to a delivery tray 58 by the forward rotation of a sheet delivery roller 57 rotatable in forward and reverse directions.

Design is made such that when two-side printing is to be effected, a flapper 61 is changed over and the delivery roller 57 is rotated in the reverse direction after the trailing edge of the sheet delivered by the forward rotation of the delivery roller 57 has passed the flapper 61. Thereby, the sheet P comes into the re-transport path 62 of a duplex transport portion whereafter it is again transported to the image forming portion 51 by a duplex roller 63. An image for a second side is formed in this image forming portion 51, whereafter the sheet P is stacked on the delivery tray 58 by the delivery roller 57.

Now, the sheet P fed from the multi-feeding portion 40 or the cassette feeding portion 16 as already described has its leading edge rammed against the pair of registration rollers 1 being at a halt, and is thereafter further transported by a predetermined amount and forms a loop, whereby the skew feed thereof is corrected.

After the so-called registration correction by such a pair of registration rollers 1 has been effected, the pair of registration rollers 1 are rotated at predetermined timing to thereby transport the sheet P to the image forming portion side, whereby the toner image formed on the photosensitive drum can be transferred to a predetermined position on the sheet P.

FIG. 17 of the accompanying drawings illustrated the construction of the vicinity of the pair of registration rollers of such a copying machine 100, and in FIG. 17, the letter S designates a loop forming space provided downstream of the pair of registration rollers. Also, a first entry route R1 is provided between the cassette feeding portion 16 and the loop forming space S, and causes the sheet P fed from the cassette feeding portion 16 to enter the loop forming space S.

A second entry route R2 is provided between the multi-feeding portion 40 and the loop forming space S, and causes a sheet P1 fed from the multi-feeding portion 40 to enter the loop forming space S. The joining portion J between the first entry route R1 and the second entry route R2 which are fed sheet entry routes is located at the entrance of the loop forming space S. A relay roller 2 is provided in the first entry route R1.

As shown in FIG. 17, design is made such that the sheet P fed from the cassette feeding portion 16 travels toward the pair of registration rollers 1 via the first entry route R1 and the loop forming space S, and the sheet P fed from the multi-feeding portion 41 travels toward the pair of registration rollers 1 via the second entry route R2, the joining portion J and the loop forming space S.

Also, in FIG. 17, a third entry route R3 is provided between the re-transport path 62 and the loop forming space S, and is a curved re-transported sheet entry route for causing a sheet P2 which has passed the re-transport path 62 to enter the loop forming space S. The third entry route R3 is designed to join at the joining portion J between the first entry route R1 and the second entry route R2.

Thereby, the re-transported sheet P2 on one side of which an image has been formed and which has entered the re-transport path 62, and thereafter again travels toward the image forming portion 51 also passes the third entry route R3, and thereafter joins at the joining portion J between the first entry route R1 and the second entry route R2, and thereafter travels toward the pair of registration rollers 1 via the loop forming space S. After the re-transported sheet P2 has thus joined at the joining portion J, the re-transported sheet P2 can be made to abut against the pair of registration rollers 1 to thereby correct the skew feed thereof.

Now, when in such a conventional copying machine (image forming apparatus), the curved third entry route R3 of the re-transport path 62 is made to join the joining portion J between the first entry route R1 and the second entry route R2, a space for disposing the third entry route R3 therein becomes necessary sideways of the joining portion J, as shown in FIG. 17.

When the space for disposing the third entry route R3 therein is thus provided sideways of the joining portion J, the width of the apparatus main body 100A becomes great. Also, when as shown in FIG. 17, the multi-feeding portion 40 is disposed sideways of the re-transport route 62, the width of the apparatus main body 100A becomes still greater.

When the width of the apparatus main body 100A becomes greater as described above, a space necessary to install the apparatus main body 100A becomes wide and also, the apparatus main body 100A becomes bulky, and this leads to an increase in cost.

SUMMARY OF THE INVENTION

So, the present invention has been made in view of such a situation and an object thereof is to provide an image forming apparatus in which the skew feed of a re-transported sheet can be corrected without an apparatus main body being made bulky.

Another object of the present invention is to provide an image forming apparatus designed such that a sheet having an image formed on a first side thereof by an image forming portion is again transported to the image forming portion so that an image may be formed on an opposite or second side of the sheet, the image forming apparatus being provided with:

a sheet feeding portion for feeding the sheet to the image forming portion;

a re-transport path along which the sheet having the image formed on the first side thereof and again transported to the image forming portion passes;

registration means provided upstream of the image forming portion for contacting with the sheet fed from the sheet feeding portion or the sheet having passed along the re-transport path in a state in which the registration means is at a holt and forming a loop in the sheet to thereby correct the skew feed of the sheet, and thereafter transporting the sheet toward the image forming portion at predetermined timing; and a loop forming space provided upstream of the registration means so as to form the loop, wherein an entrance to the loop forming space for the sheet having passed along the re-transport path is formed downstream of an entrance to the loop forming space for the sheet fed from the sheet feeding portion.

DETAILED DESCRIPTION OF THE PREFERRED EMBODIMENTS

An embodiment of the present invention will hereinafter be described in detail with reference to the drawings.

Figure 1:
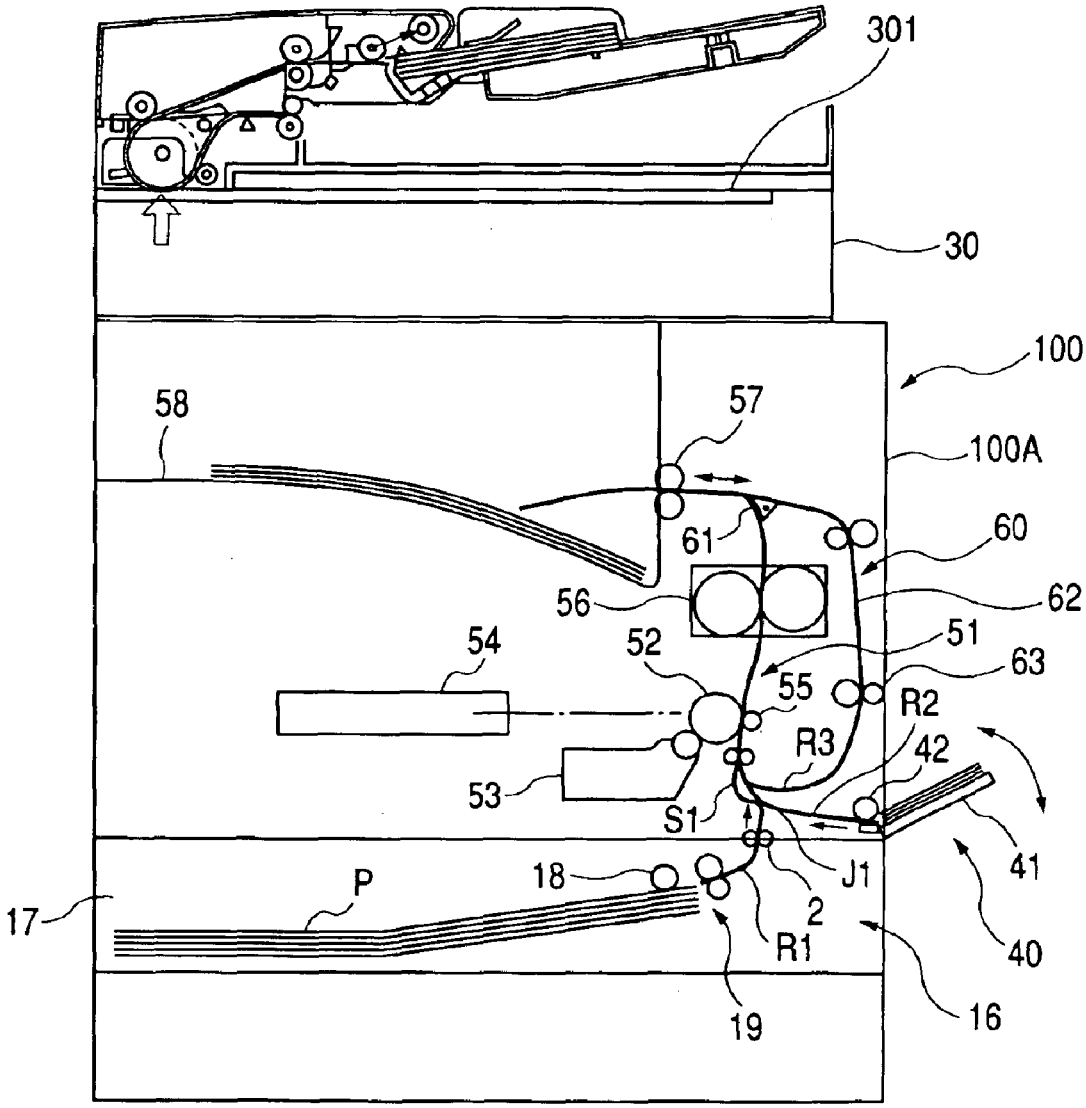
FIG. 1 schematically shows the construction of a copying machine which is an example of an image forming apparatus according to an embodiment of the present invention.
Figure 16:
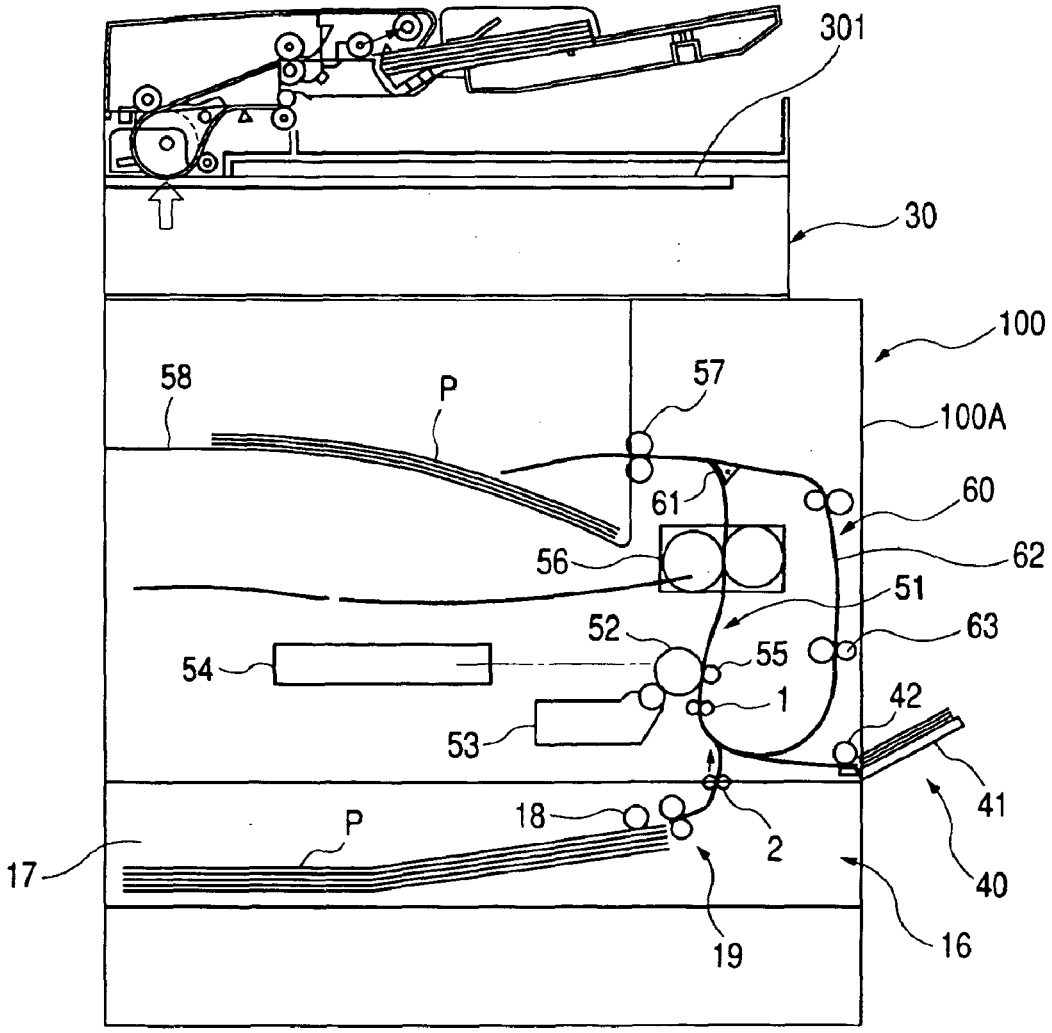
FIG. 16 schematically shows the construction of a copying machine which is an example of a conventional image forming apparatus.

FIG. 1 schematically shows the construction of a copying machine which is an example of an image forming apparatus according to the embodiment of the present invention. In FIG. 1, the same reference characters as those in FIG. 16 designate the same or corresponding portions.

In FIG. 1, a loop forming portion S1 forms a loop forming space provided upstream of a pair of registration rollers 1 so as to form a loop for correcting the skew feed of a sheet P. A first entry route (a fed sheet entry route) R1 and a second entry route R2 joins each other at a joining portion J1.

Figure 2:
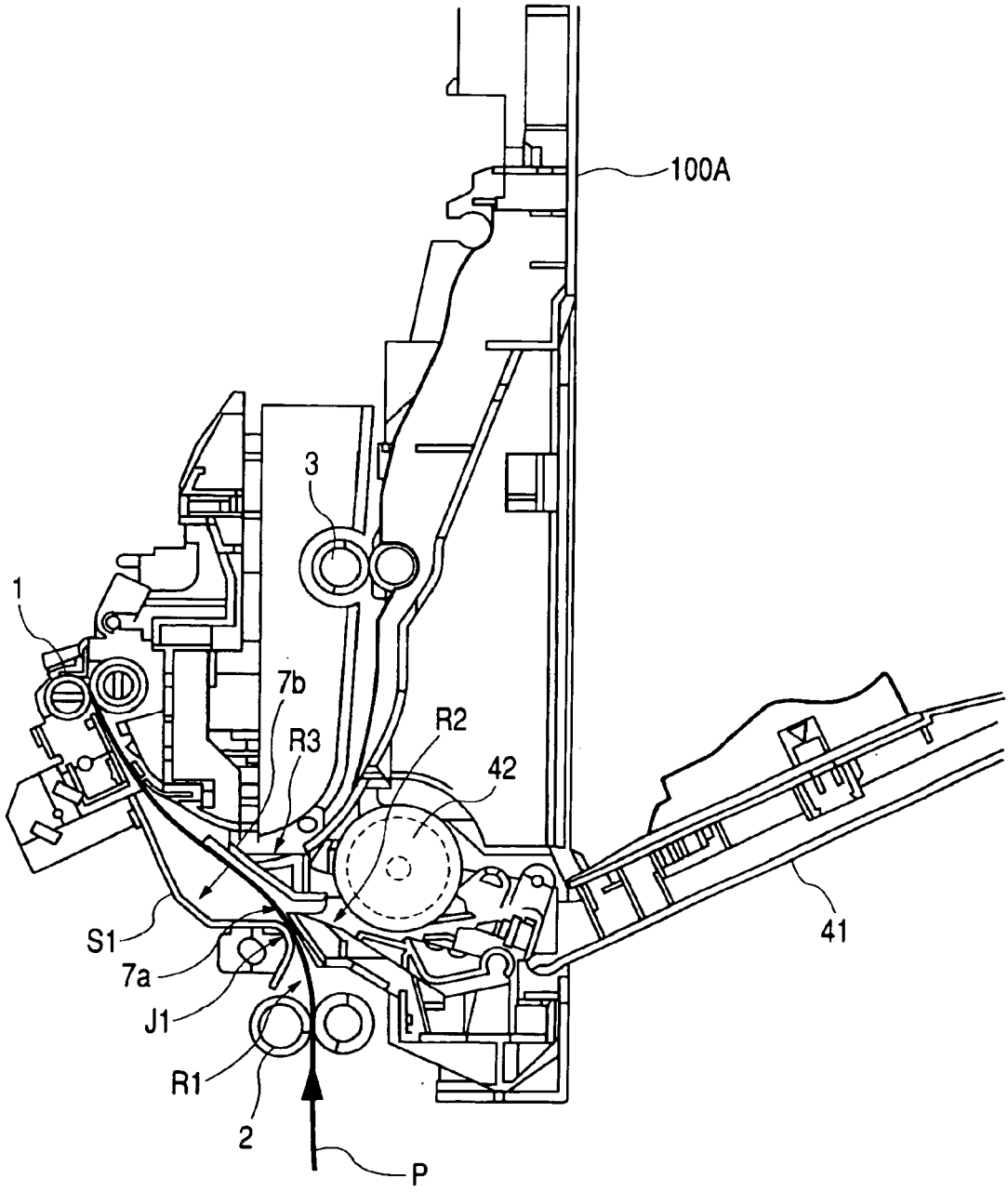
FIG. 2 shows the construction of the vicinity of the loop forming portion of the copying machine of FIG. 1.

FIG. 2 shows the construction of the vicinity of the loop forming portion. In FIG. 2, the reference character 7*a* designates an entrance to the loop forming portion S1 for the first entry route R1 and the second entry route R2 joining each other at the joining portion J1, and the reference character 7*b* denotes an entrance to the loop forming portion S1 for a third entry route (a re-transported sheet entry route) R3 formed downstream of the entrance 7*a* to the loop forming portion S1 for the first entry route R1 and the second entry route R2.

The entrance (hereinafter referred to as the upper entrance) 7*b* to the third loop forming portion S1 for the third entry route R3 is formed downstream of the entrance (hereinafter referred to as the lower entrance) 7*a* to the loop forming portion S1 for the first entry route R1 and the second entry route R2, as described above, that is, the entrance 7*b* to the loop forming portion S1 for the sheet having passed along the re-transport path 62 is formed downstream of the entrance to the loop forming portion S1 for the sheet fed from the cassette feeding portion 16 or the multi-feeding portion 40, whereby the location of the third entry route R3 (re-transport path 62) can be brought near the loop forming portion side.

Figure 17:
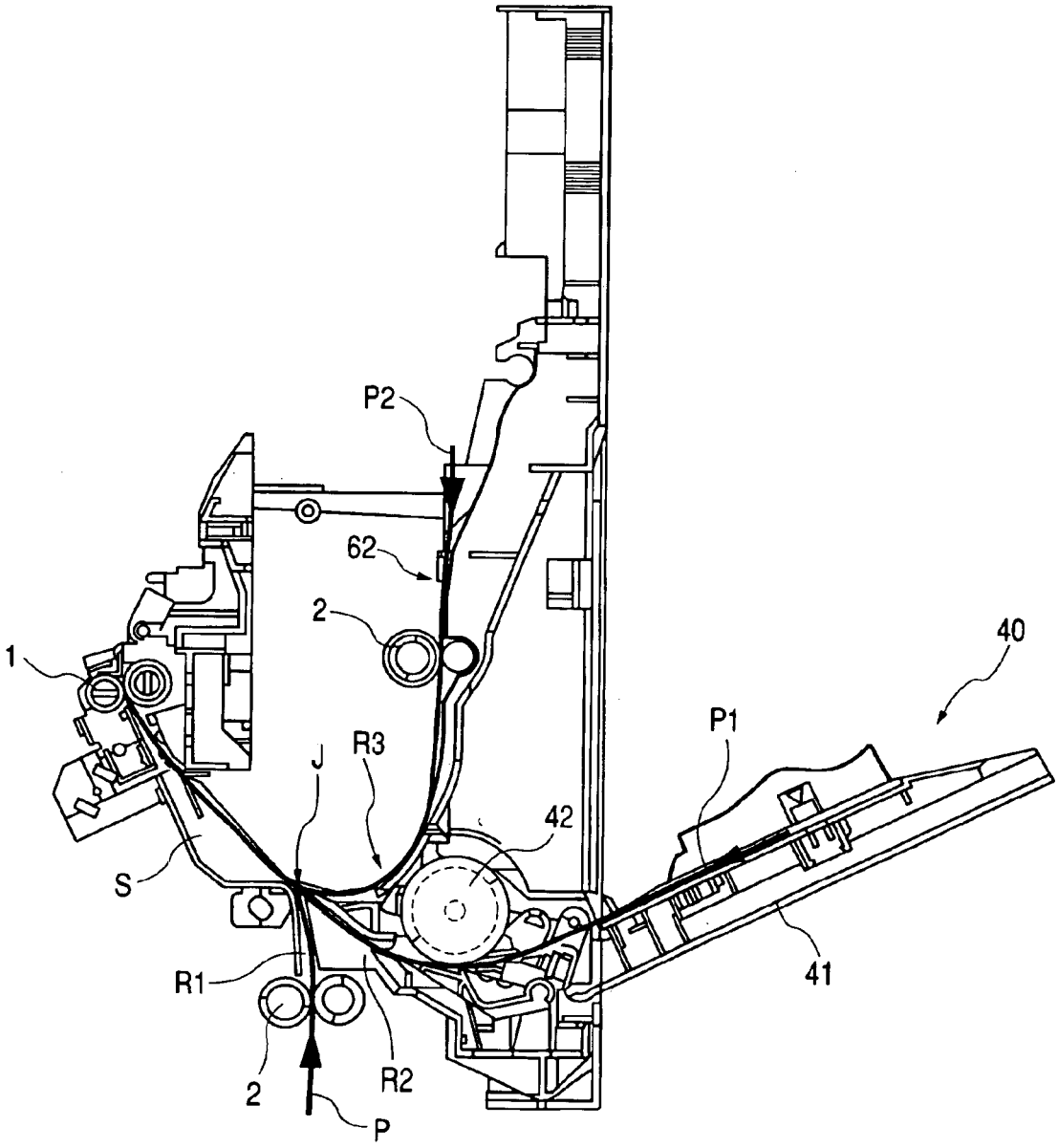
FIG. 17 illustrates the construction of the vicinity of the pair of registration rollers of the conventional copying machine.

Thereby, a space for disposing therein the third entry route R3, in other words, the re-transport path 62, can also be brought near the loop forming portion side, and as a result, the width of the apparatus main body 100A becomes narrow. Also, when the multi-feeding portion 40 is disposed sideways of the re-transport path 62, the width of the apparatus main body 100A can be made narrow as compared with FIG. 17 already described.

Description will now be made of the sheet feeding operation in the copying machine 100 constructed as described above.

Figure 3:
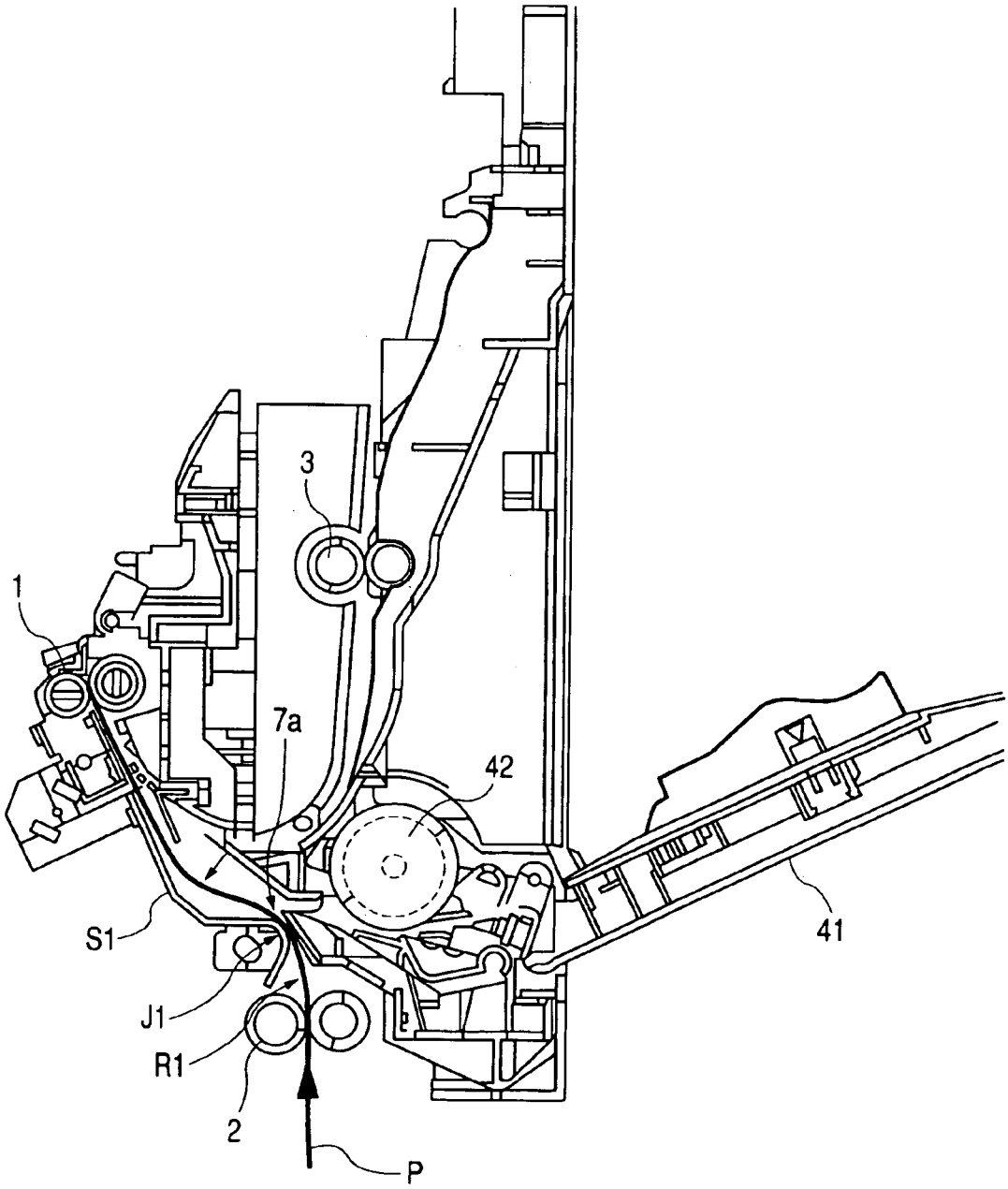
FIG. 3 shows a state in which the leading edge of a sheet fed from the cassette feeding portion of the copying machine of FIG. 1 has struck against a pair of registration rollers being at a halt.

When, for example, a sheet P is fed from the cassette feeding portion 16, this sheet passes the first entry route R1 and the joining portion J1 as shown in FIG. 2, and thereafter enters the loop forming portion S1 from the lower entrance 7*a*, and the leading edge thereof strikes against the pair of registration rollers 1 being at a halt. When thereafter, the sheet is transported by a predetermined amount, this sheet P is flexed in the direction indicated by the arrow shown in FIG. 3 by the loop forming portion S1 so as to form a loop.

Figure 4:
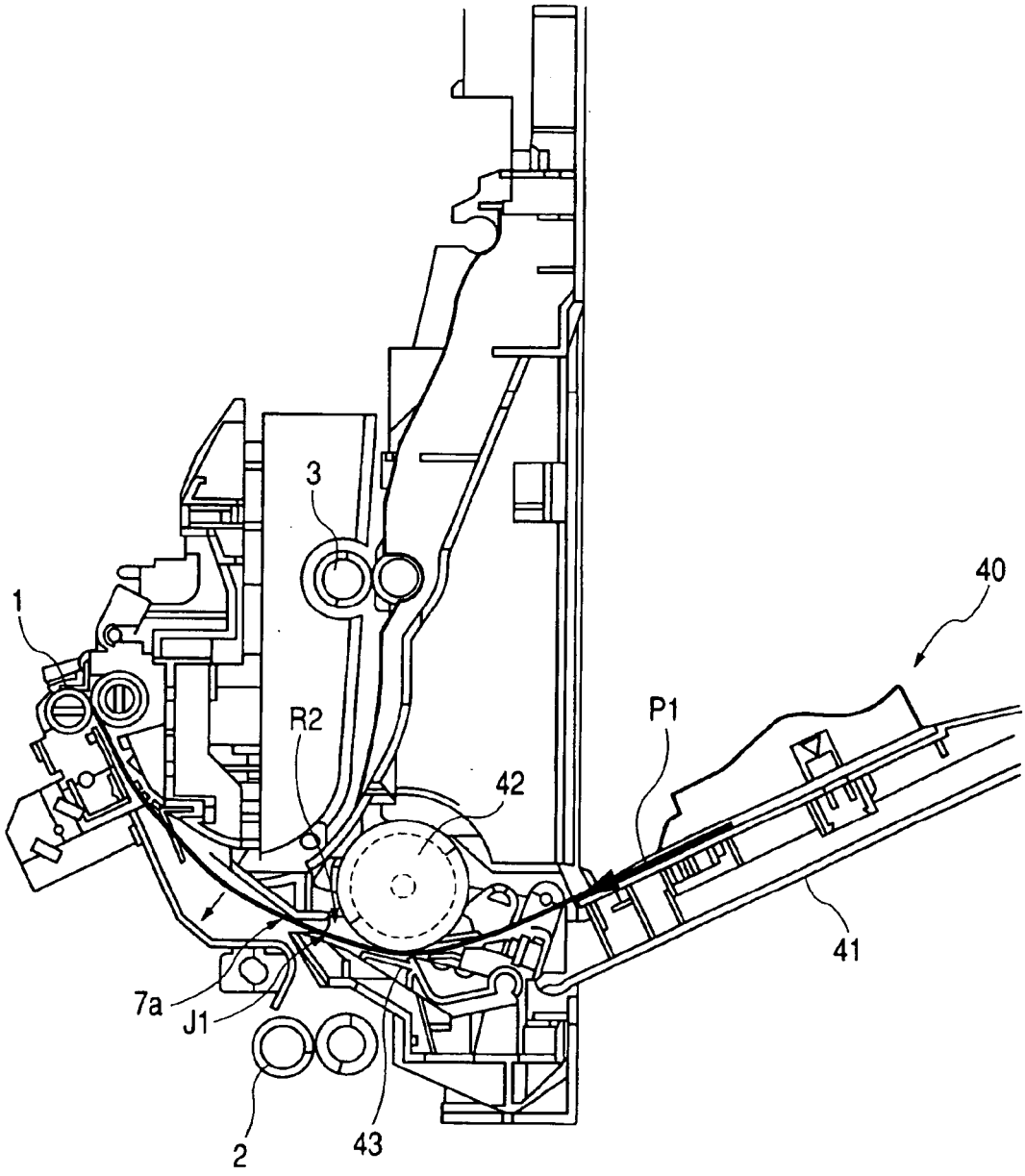
FIG. 4 shows a state in which the leading edge of a sheet fed from the multi-feeding portion of the copying machine of FIG. 1 has struck against the pair of registration rollers being at a halt.
Figure 5:
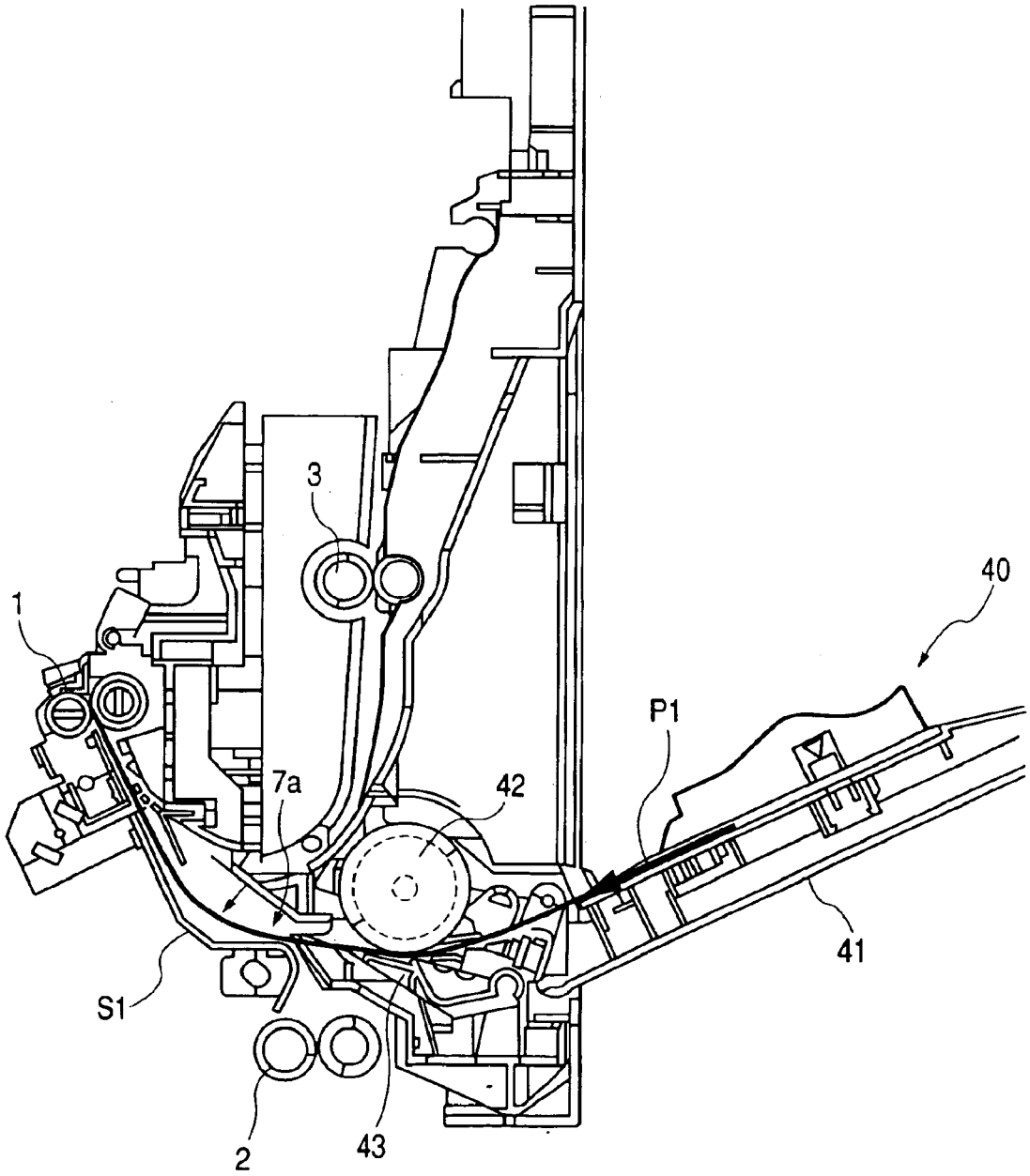
FIG. 5 shows the manner in which the sheet fed from the multi-feeding portion of the copying machine of FIG. 1 forms a loop.

Also, when a sheet P1 is fed from the multi-feeding portion 40, the sheet P1 fed from the tray by a feeding roller 42 and a separating pad 43 passes the second entry route R2 and the joining portion J1, as shown in FIG. 4, and thereafter enters the loop forming portion S1 from the lower entrance 7*a*, and the leading edge thereof strikes against the pair of registration rollers 1 being at a halt. When thereafter, the sheet P1 is transported by a predetermined amount, this sheet P1 is flexed in the direction indicated by the arrow shown in FIG. 5 by the loop forming portion S1 so as to form a loop.

Figure 6:
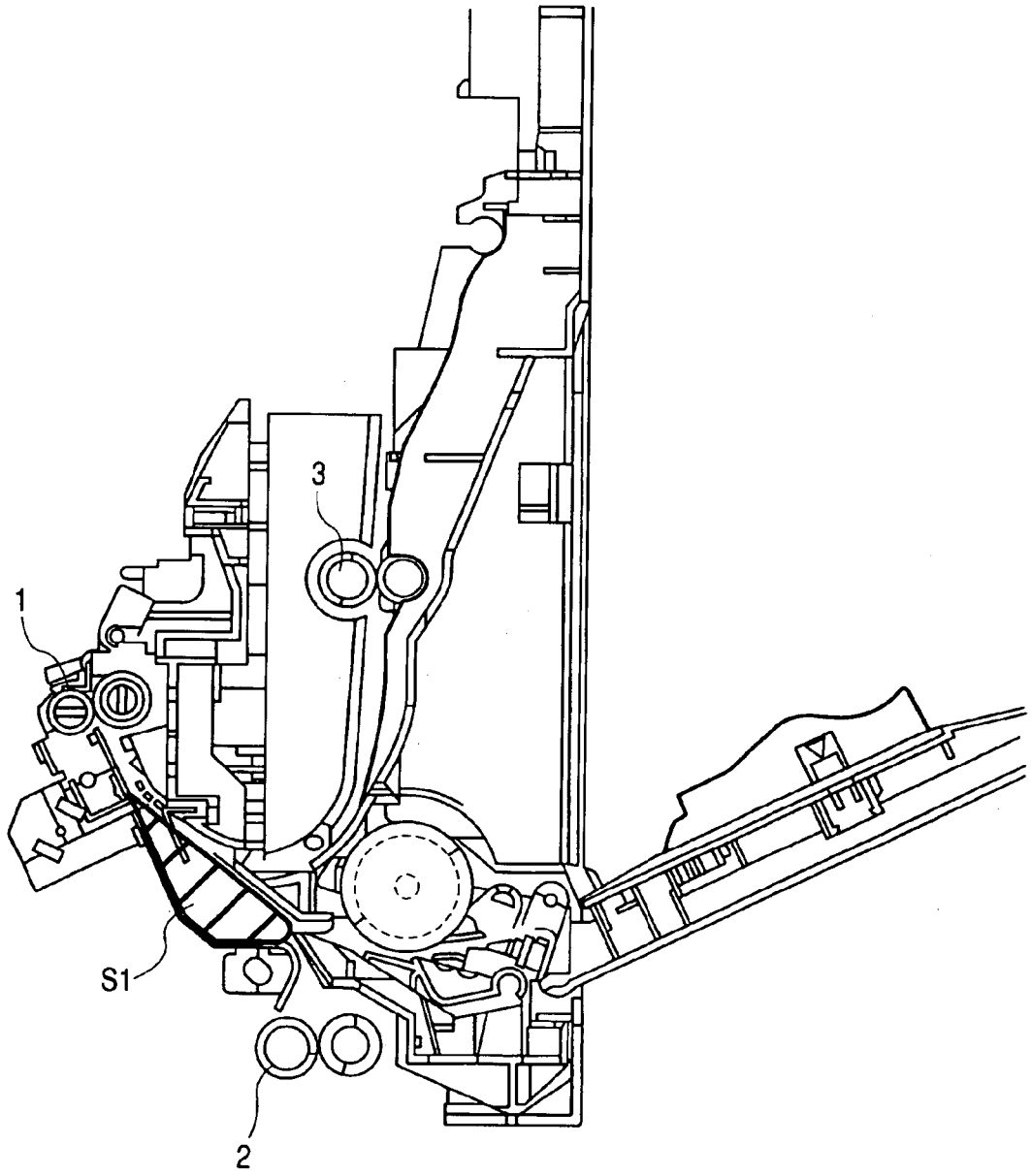
FIG. 6 shows a loop forming space for the sheets fed from the cassette feeding portion and multi-feeding portion of the copying machine of FIG. 1.

That is, the sheets P and P1 fed from the cassette feeding portion 16 and the multi-feeding portion 40, respectively, are formed into loops in a portion of the loop forming portion S1 indicated by hatching, i.e., the entire loop forming space, as shown in FIG. 6.

Figure 7:
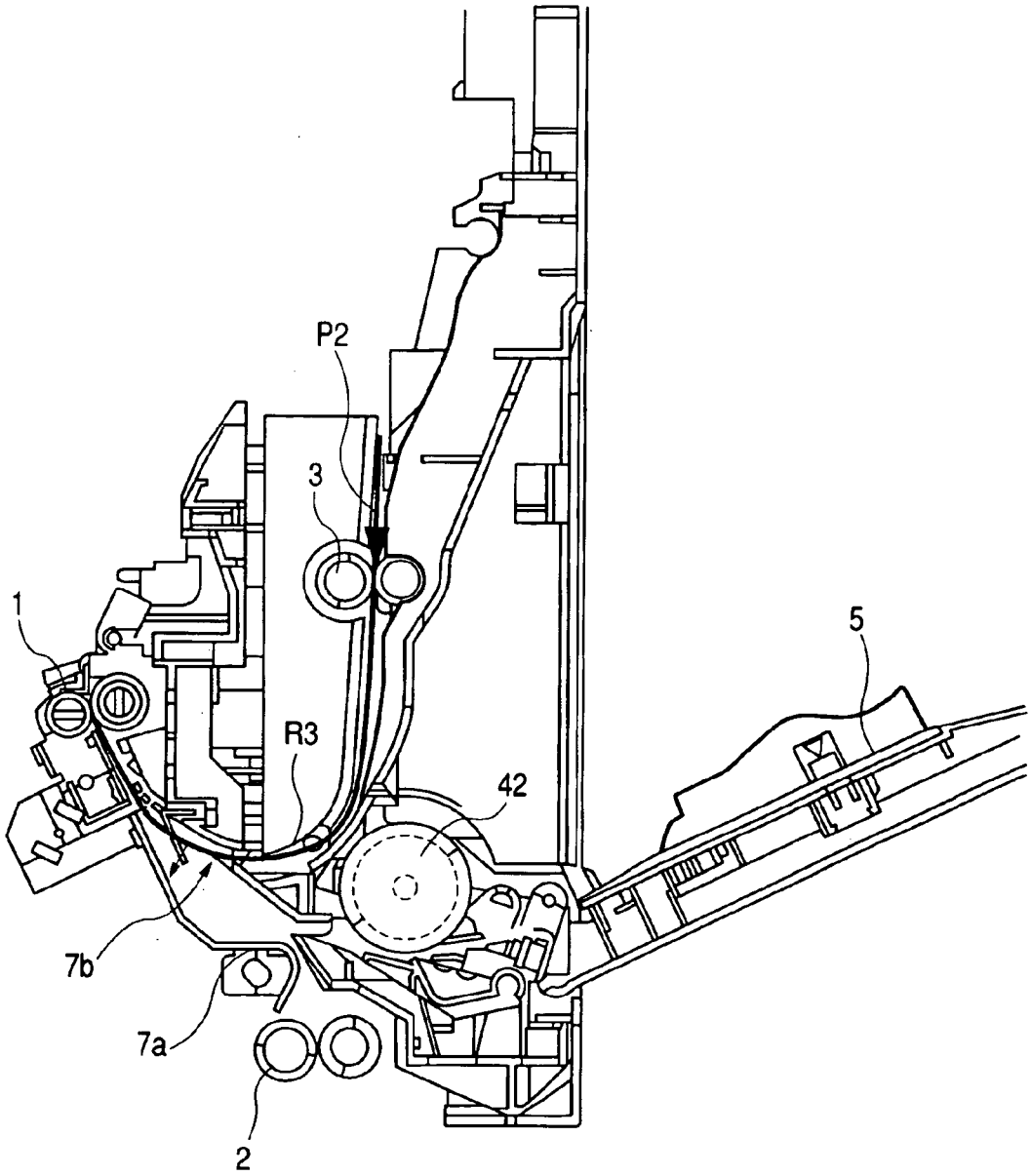
FIG. 7 shows a state in which the leading edge of a sheet re-transported from the duplex transport portion of the copying machine of FIG. 1 has struck against the pair of registration rollers being at a halt.

On the other hand, when a sheet P2 re-transported from the duplex transport portion 60 is transported, the re-transported sheet P2, as shown in FIG. 7, passes the curved third entry route of the re-transport path 62, and thereafter enters the loop forming portion S1 from the upper entrance 7*b*, and the leading edge thereof strikes against the pair of registration rollers 1 being at a halt. When thereafter, the sheet P2 is transported by a predetermined amount, this sheet P2 is flexed in the direction indicated by the arrow shown in FIG. 8 by the loop forming portion S1 so as to form a loop.

Figure 8:
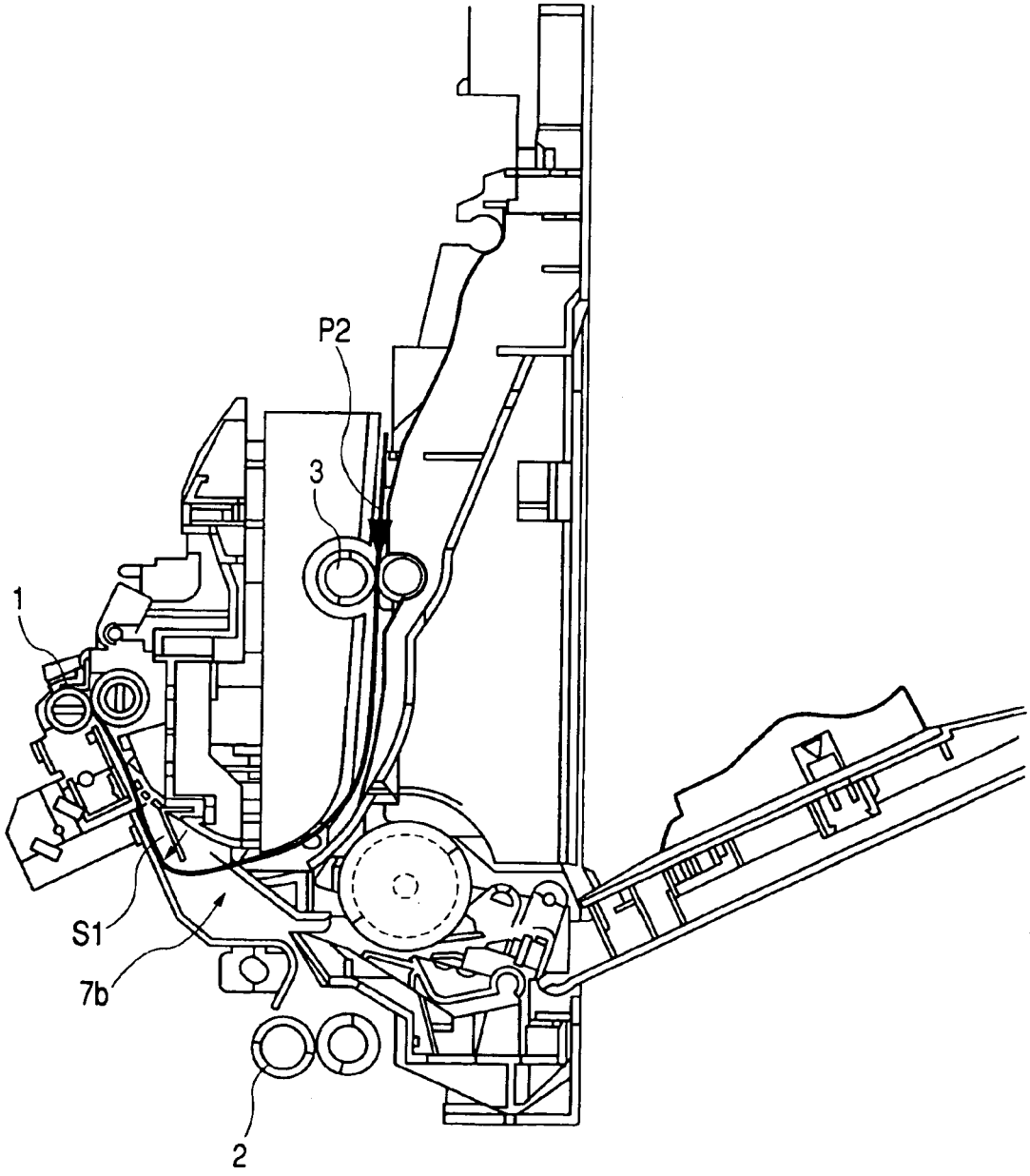
FIG. 8 shows the manner in which the sheet re-transported from the duplex transport portion of the copying machine of FIG. 1 forms a loop.

The upper entrance 7*b* is formed downstream of the lower entrance 7*a*, as already described, and therefore the sheet P2, as shown in FIG. 8, is flexed in the downstream side portion of the loop forming portion S1 so as to form a loop.

Figure 9:
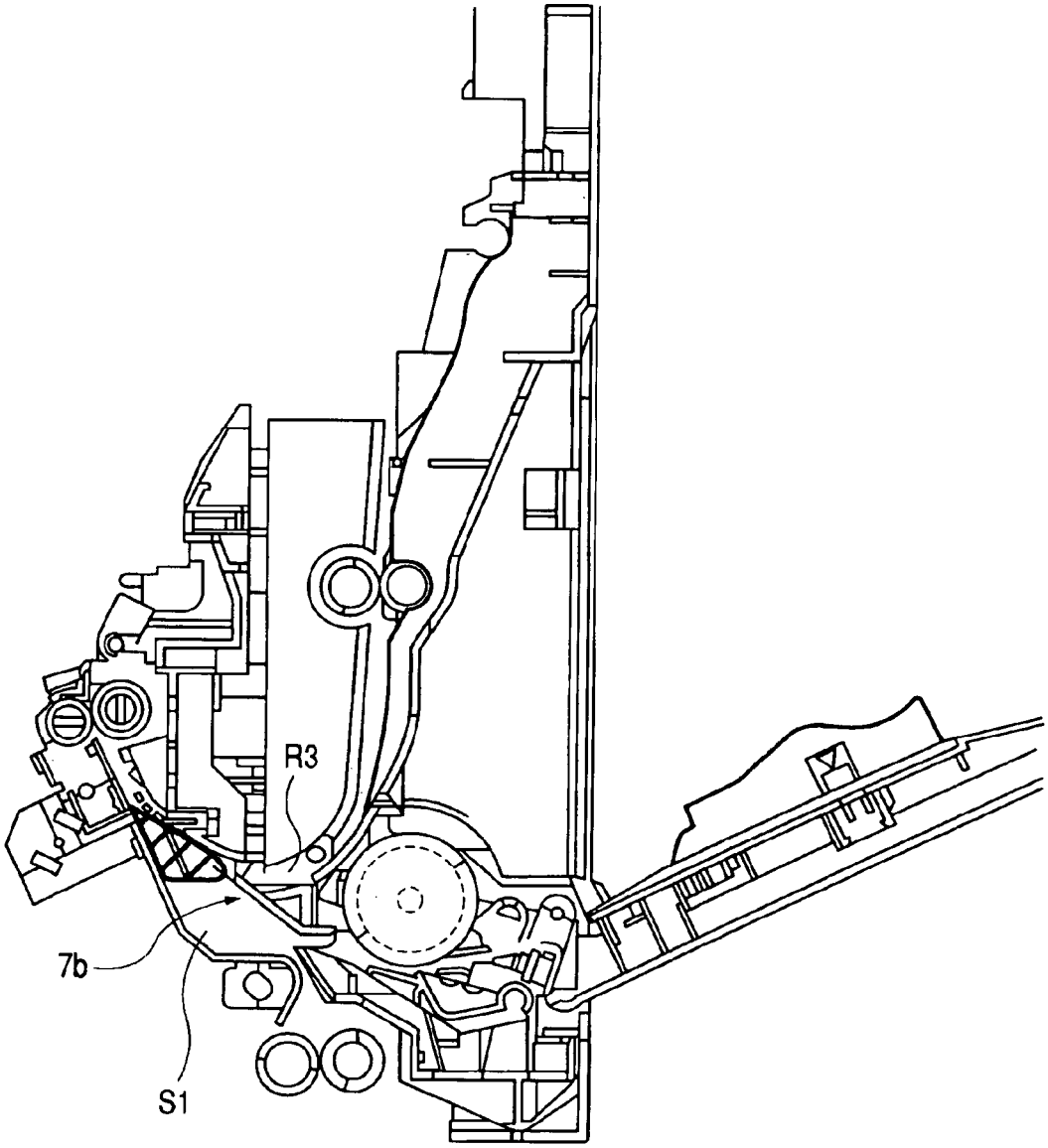
FIG. 9 shows a loop forming space for the sheet re-transported from the duplex transport portion of the copying machine of FIG. 1.

That is, when the entrance to the loop forming portion S1 is formed downstream, the re-transported sheet p2 having entered the loop forming portion S1 is formed into a loop in the downstream side space of the loop forming portion S1 indicated by hatching in FIG. 9.

Figure 10:
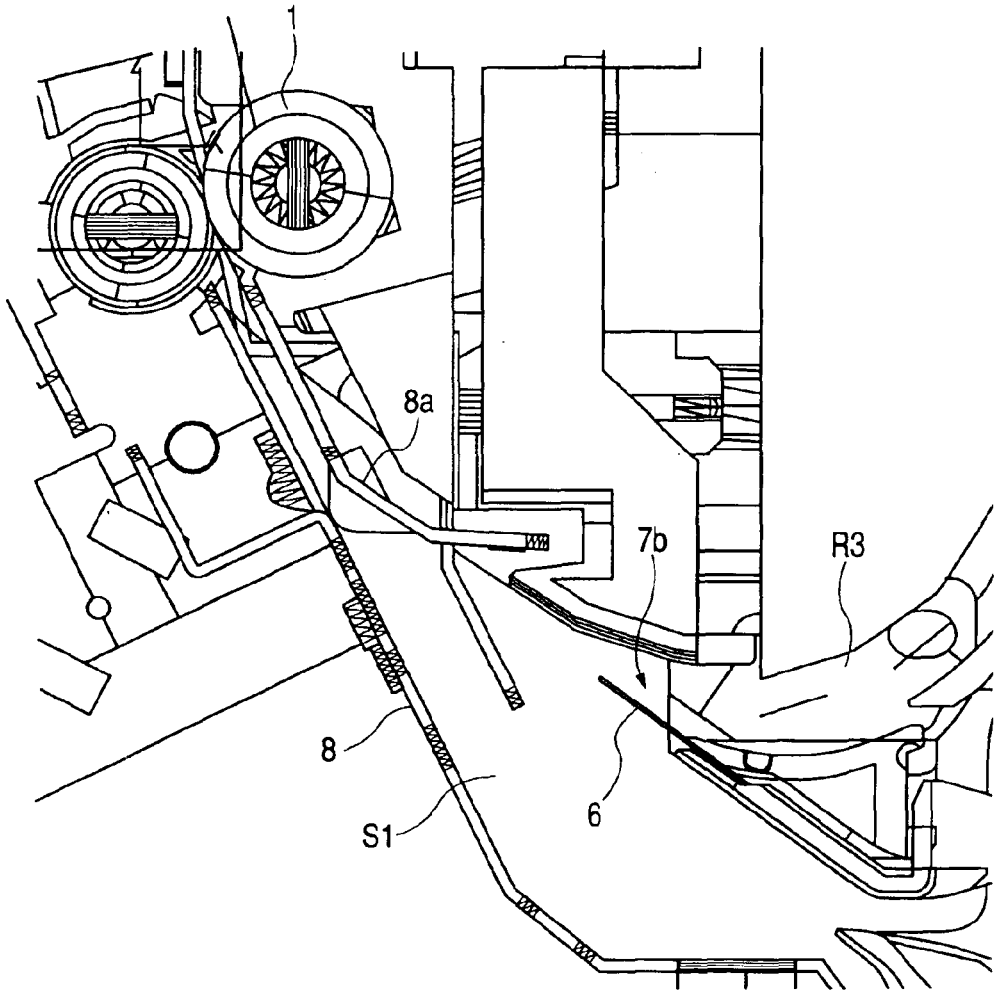
FIG. 10 is an enlarged view of the loop forming portion of the copying machine of FIG. 1.

Now, when the entrance 7*b* to the loop forming portion S1 is formed downstream as described above, the sheet P2 enters the loop forming portion S1 via the upper entrance 7*b*, whereafter the leading edge of the sheet P2 comes to strike against the ante-registration guide 8 facing the upper entrance 7*b*, of ante-registration guides 8 and 8*a* constituting the side wall surface of the loop forming portion S1 shown in FIG. 10, and guiding the sheet P2 to the pair of registration rollers 1.

To reliably guide to the pair of registration rollers 1 the sheet P2 of which the leading edge strikes against the ante-registration guide 8 after the sheet P2 has entered the loop forming portion S1 as described above, it is necessary that the angle at which the sheet P2 strikes against the ante-registration guide 8 be of the order of 30 to 40 degrees. When this angle is exceeded, corner bending (curled selvage) will occur to the leading edge portion of the sheet P2. Particularly, the sheet P2 entering from the re-transport path 62 has once passed through the fixing apparatus 56 and therefore, corner bending is liable to occur particularly due to fixation curl or the like.

Figure 11:
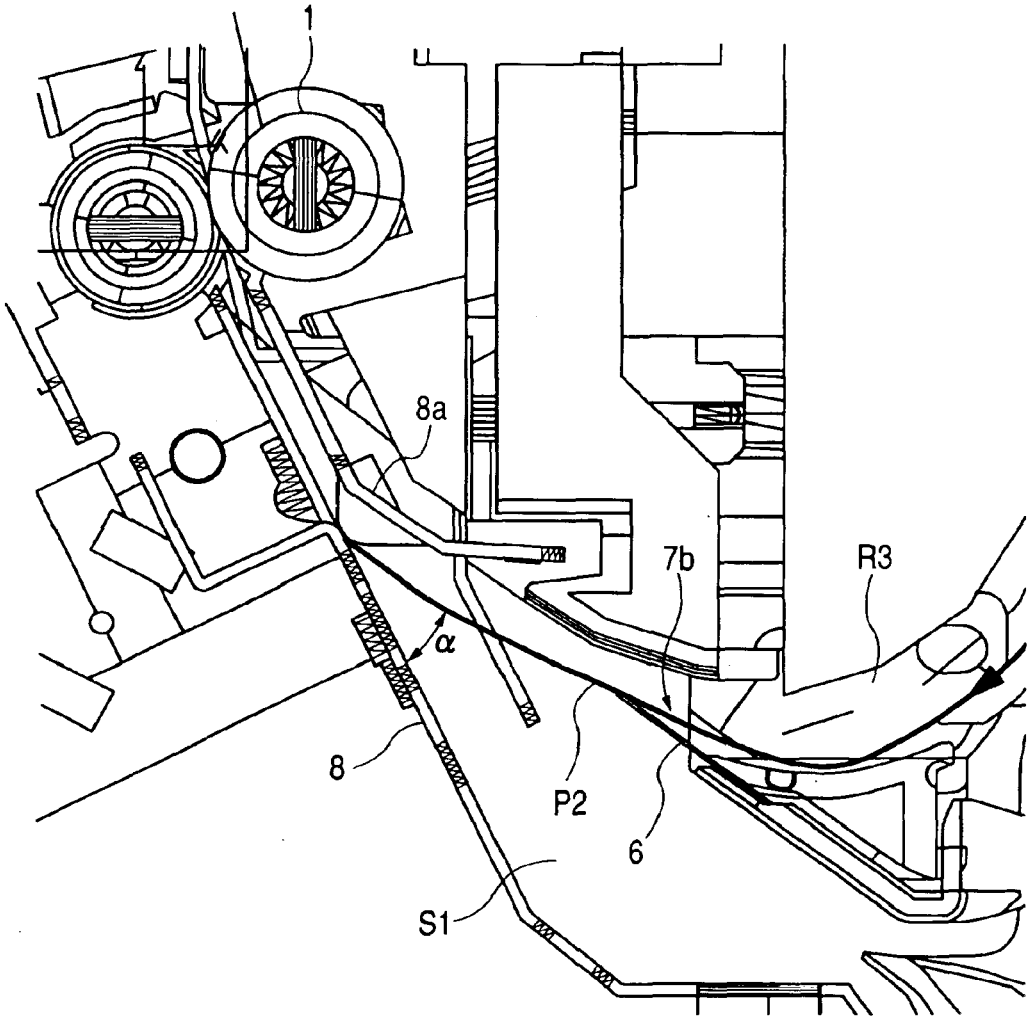
FIG. 11 illustrated the action of an entry assisting sheet provided in the loop forming portion of FIG. 10.

So, in the present embodiment, as shown in FIG. 10, an entry assisting sheet 6 which is a guide member for guiding the sheet P2 entering the loop forming portion S1 is provided at the upper entrance 7*b*, and the sheet P2 is guided by this entry assisting sheet 6, whereby the leading edge of the sheet P2 comes to strike against the ante-registration guide 8, as shown in FIG. 11.

Figure 12:
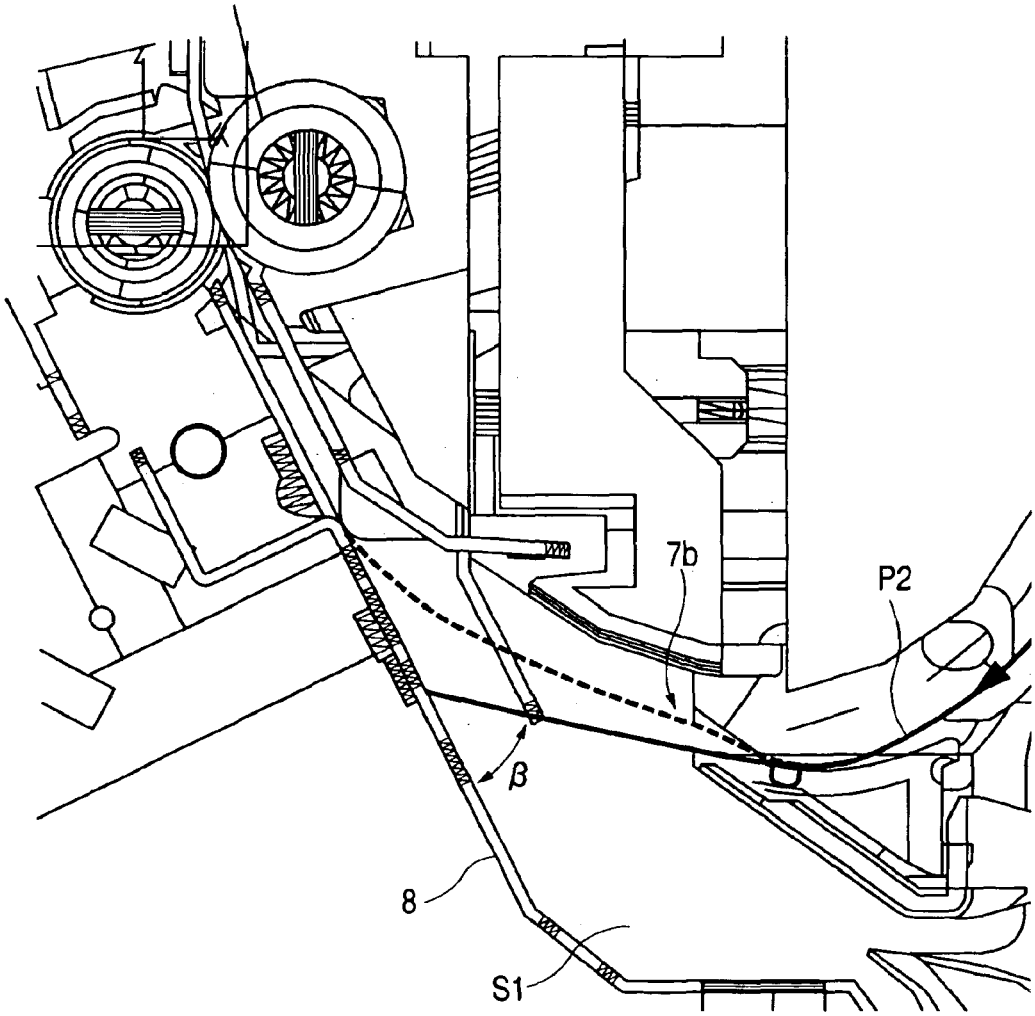
FIG. 12 shows the state during the entry of the sheet when the entry assisting sheet is not provided in the loop forming portion of FIG. 10.

The reference sign "α" shown in FIG. 11 indicates an angle at a moment when the sheet P2 strikes against the ante-registration guide 8, and by providing such an entry assisting sheet 6, this angle α can be of the order of 30 to 40 degrees at maximum. When the entry assisting sheet 6 is absent, an angle "β" at the moment when the sheet P strikes against the ante-registration guide 8 exceeds 40 degrees ($\alpha<\beta$) as shown in FIG. 12, and corner bending is liable to occur.

As described above, the entry assisting sheet 6 is provided at the upper entrance 7*b*, and the sheet P2 entering the loop forming portion S1 from the upper entrance 7*b* is caused to contact with the ante-registration guide 8 at the order of 30 to 40 degrees at maximum, whereby the sheet P2 can be guided to the pair of registration rollers 1 without corner bending being caused.

Figure 13:
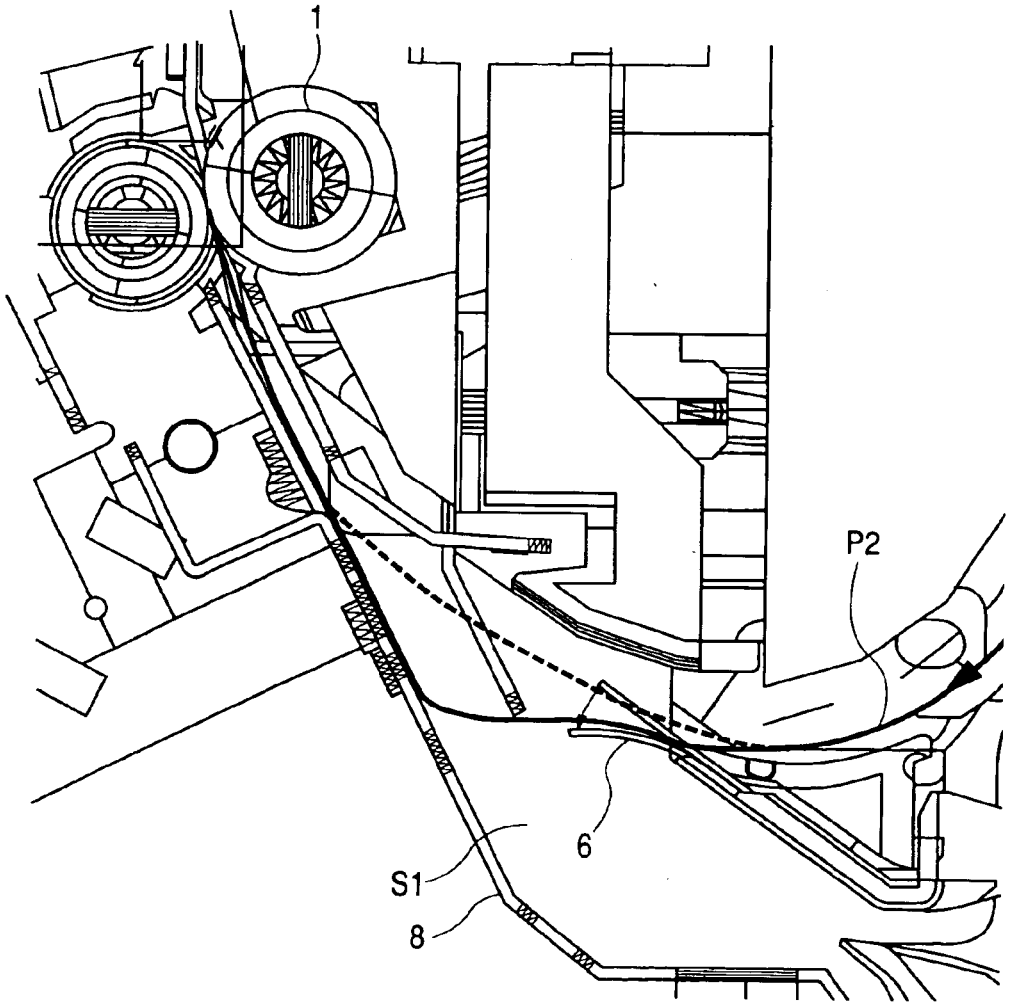
FIG. 13 shows the operation of the entry assisting sheet.

Further, in the present embodiment, the entry assisting sheet 6 is formed by a member having flexibility, and by the entry assisting sheet 6 thus having flexibility, when the sheet P2 forms a loop as shown in FIG. 13, the entry assisting sheet 6 is pressed by the sheet P2 forming a loop, and comes to be fixed in the direction of arrow indicated in FIG. 13.

Figure 14:
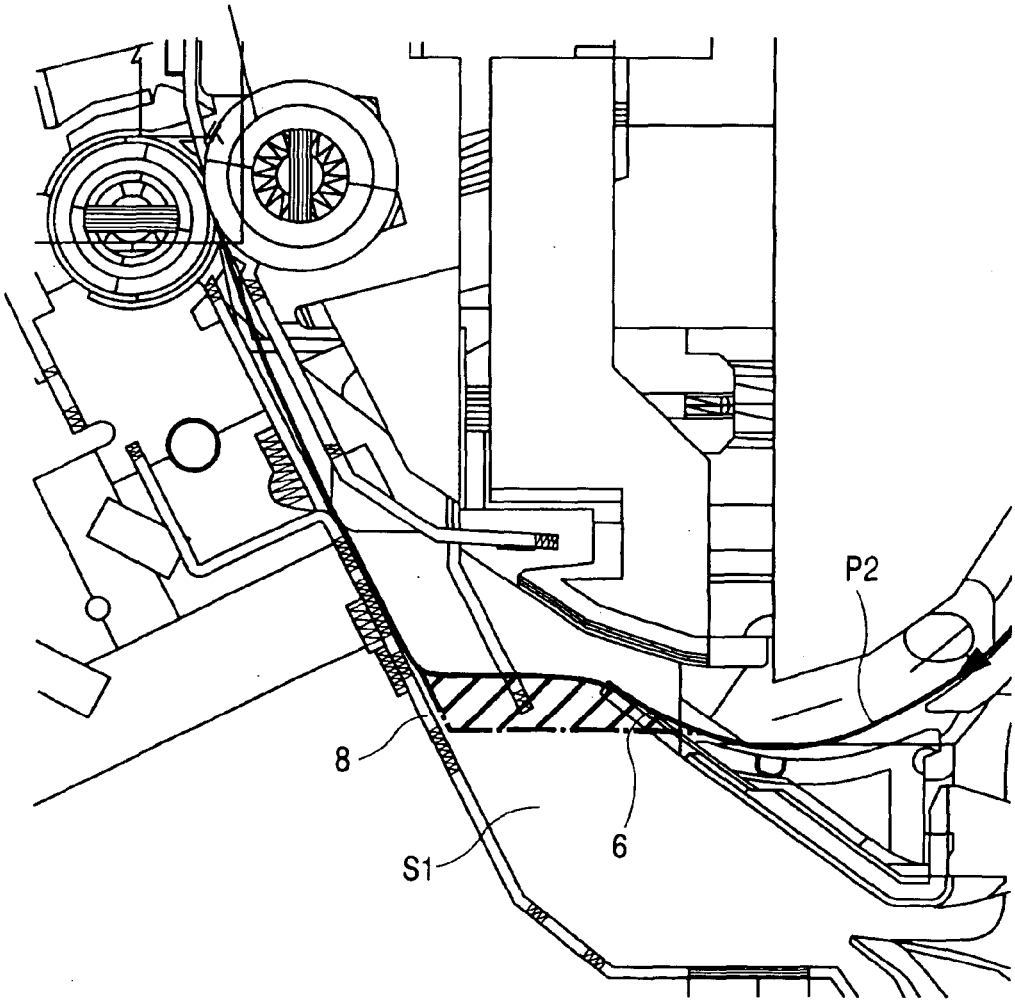
FIG. 14 shows that the loop forming space differs depending on the difference in the strength of the entry assisting sheet.

When the entry assisting sheet 6 is formed of a material of strong rigidity which is not flexed, the entry assisting sheet 6 is not flexed even if it is pressed by the sheet P2 and therefore, as shown in FIG. 14, a space in which a loop can be formed becomes small. The hatched portion in FIG. 14 indicates an area in which the space in which the loop can be formed has become small.

When the space in which the loop can be formed thus becomes small, a loop of a sufficient size cannot be formed and therefore, the correction of the skew feed of the sheet P2 cannot be effected reliably, and an appropriate image cannot be formed on the sheet P2.

Accordingly, when as in the present embodiment, the entry assisting sheet 6 is formed by a member having flexibility and a loop is formed, the loop forming space is increased in such a manner that the entry assisting sheet 6 is flexed, whereby even if the loop forming portion is the downstream side portion of the loop forming portion S1 indicated by hatching in FIG. 9, a loop can be sufficiently formed, whereby the correction of the skew feed of the sheet P2 can be effected reliably. That is, even in a small space, a necessary loop can be formed.

Further, when during loop forming, the entry assisting sheet 6 is flexed so that the loop forming space may increase, the force of restitution of the entry assisting sheet 6 thereafter comes to act on the sheet P2. Thus, the sheet P2 forming a loop is pushed against the pair of registration rollers 1 with a stronger force by this returning force, and skew feed correcting capability is improved.

As described above, the entry assisting sheet 6 is protrudingly provided from the lower end of the upper entrance 7*b* toward the loop forming portion side, whereby the sheet P2 entering the loop forming portion S1 from the upper entrance 7*b* can be made to abut against the ante-registration guide 8 at the order of 30 to 40 degrees even at maximum, whereby the sheet P2 can be guided to the pair of registration rollers 1 without corner bending being caused.

Also, by the entry assisting sheet 6 being formed by a member having flexibility, a loop can be sufficiently formed even if the loop forming space is a part of the loop forming portion S1, and the correction of the skew feed of the sheet P2 can be effected reliably.

Figure 15:
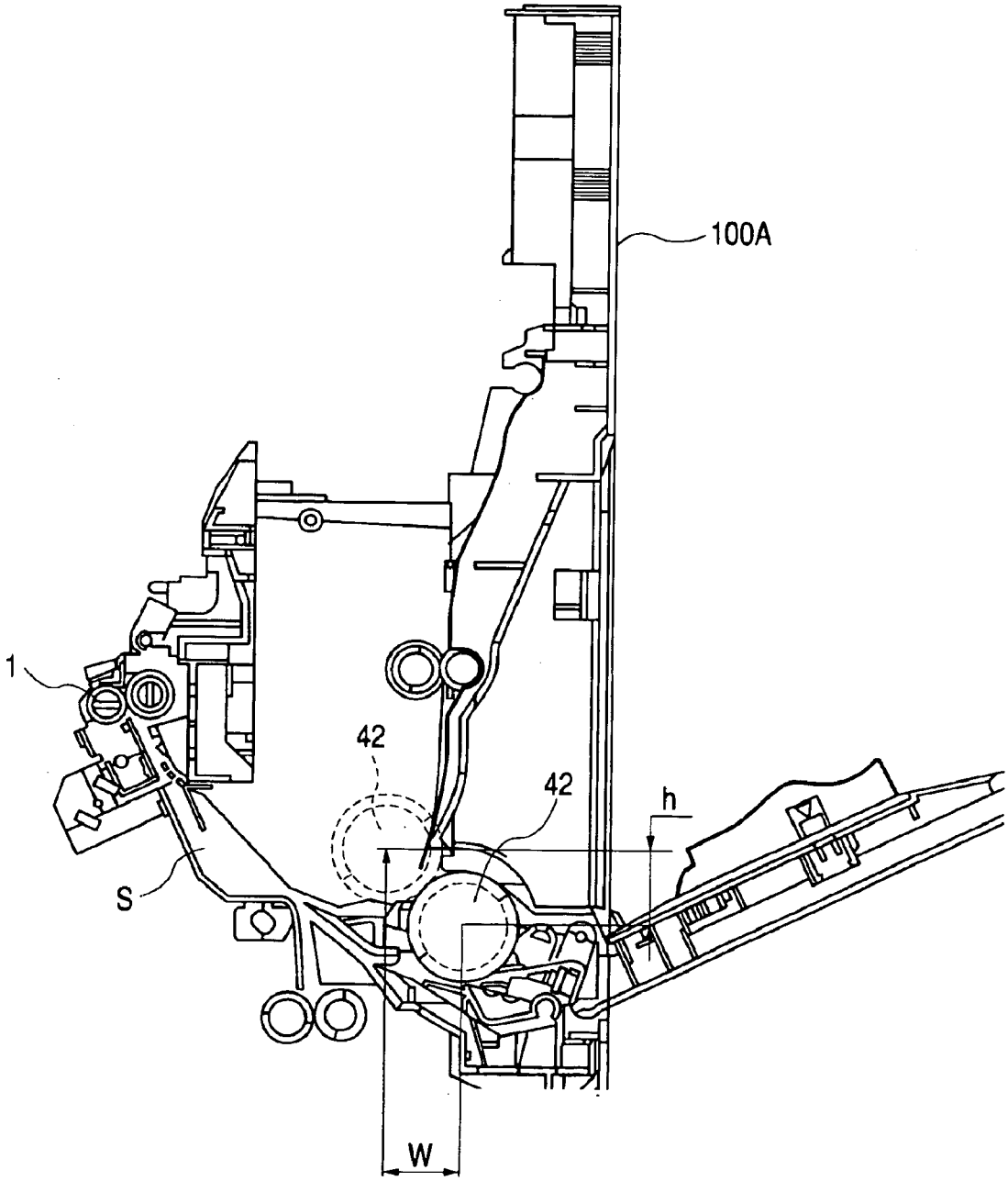
FIG. 15 illustrates the difference between the construction of the present invention and the construction of an example of the conventional art.

FIG. 15 shows the locations of the feeding rollers 42 of a copying machine provided with the third entry route R3 (re-transport path 62) at such a location as in the present embodiment and a conventional copying machine, and when the copying machine is constructed like the present embodiment, the location of the feeding roller 42 in the present embodiment indicated by broken line can be brought near the loop forming portion side by W in the widthwise direction and h in the height direction as compared with the conventional feeding roller 42 indicated by solid line. Thereby, the apparatus main body 100A can be made small. In the actual example of design, both of W and h became smaller by the order of 30 mm.

What is claimed is:

1. An image forming apparatus in which a sheet having an image formed on a first side thereof by an image forming portion is again transported to said image forming portion so that an image may be formed on a second side of the sheet, said image forming apparatus comprising:

a sheet feeding portion for feeding a sheet to said image forming portion;

a re-transport path along which the sheet having the image formed on the first side thereof and again transported to said image forming portion passes;

registration means provided upstream of said image forming portion for contacting with the sheet fed from said sheet feeding portion or the sheet having passed along said re-transport path, wherein the registration means forms a loop in the sheet to thereby correct the skew feed of the sheet, and thereafter transports the sheet toward said image forming portion at predetermined timing; and a loop forming space provided upstream of said registration means so as to form the loop, wherein an entrance to said loop forming space for the sheet having passed along said re-transport path is formed downstream of an entrance to said loop forming space for the sheet fed from said sheet feeding portion.

2. An image forming apparatus according to claim 1, further comprising:

a fed sheet entry route provided between said sheet feeding portion and said loop forming space for causing the sheet from said sheet feeding portion to enter said loop forming space; and a re-transported sheet entry route provided between said re-transport path and said loop forming space for causing the sheet having passed along said re-transport path to enter said loop forming space, wherein an entrance of said re-transported sheet entry route to said loop forming space is formed downstream of an entrance of said fed sheet entry route.

3. An image forming apparatus according to claim 2, wherein a guide member for guiding the sheet entering said loop forming space from said re-transported sheet entry route is provided at an entrance of said re-transported sheet entry route to said loop forming space.

4. An image forming apparatus according to claim 3, wherein the sheet entering said loop forming space from the entrance of said re-transported sheet entry route to said loop forming space by said guide member is made to abut against a side wall surface of said loop forming space which faces the entrance to said loop forming space at a predetermined angle.

5. An image forming apparatus according to claim 3, wherein said guide member is formed by a flexible member so as to be flexed by being pressed by the sheet forming the loop after having entered said loop forming space via said re-transported sheet entry route.

6. An image forming apparatus in which a sheet having an image formed on a first side thereof by an image forming portion is again transported to said image forming portion so that an image may be formed on a second side of the sheet, said image forming apparatus comprising:

a sheet feeding portion having feeding rollers and a sheet cassette which are disposed under the image forming portion;

registration rollers disposed between said sheet feeding portion and the image forming portion, wherein the registration rollers are form a loop in the sheet to thereby correct the skew feed of the sheet, and thereafter transports the sheet toward said image forming portion at predetermined timing;

an entry route connecting said sheet feeding portion with the registration rollers;

a re-transport path along which the sheet having the image formed on the first side thereof and again transported to said registration rollers passes, and a loop forming space provided upstream of the registration rollers, wherein an entrance of the re-transport path to the loop forming space is formed downstream of an entrance of the entry route to said loop forming space.

7. An image forming apparatus according to claim 6, wherein a guide member is disposed at the entrance of said loop forming space from said re-transported path, wherein the sheet guided by said guide member is made to abut against a side wall surface of said loop forming space at a predetermined angle.

8. An image forming apparatus according to claim 7, wherein said guide member is formed by a flexible member so as to be flexed by being abutted by the sheet forming the loop.

* * * * *

UNITED STATES PATENT AND TRADEMARK OFFICE

CERTIFICATE OF CORRECTION

PATENT NO. : 6,889,031 B2
DATED : May 3, 2005
INVENTOR(S) : Takeshi Tsuchida

It is certified that error appears in the above-identified patent and that said Letters Patent is hereby corrected as shown below:

Title page,
Item [56], References Cited, FOREIGN PATENT DOCUMENTS,
"JP 2001305914 * 11/2001" should read -- JP 2001-305914 * 11/2001 --.

Column 1,
Line 32, "a" should be deleted, and "portion" should read -- portions --.

Column 2,
Line 19, "red" should read -- read --.

Column 4,
Line 38, "holt" should read -- halt --.

Column 5,
Line 50, "joins" should read -- join --.

Column 10,
Line 6, "are" should be deleted.
Line 8, "transports" should read -- transport --.
Line 14, "passes, and" should read -- passes; and --.

Signed and Sealed this

Thirteenth Day of September, 2005

JON W. DUDAS
*Director of the United States Patent and Trademark Office*